US009405240B2

(12) United States Patent
Koyama

(10) Patent No.: US 9,405,240 B2
(45) Date of Patent: Aug. 2, 2016

(54) IMAGE FORMING APPARATUS WITH A HEAT-CONTROLLABLE FIXING UNIT AND COMPUTER READABLE MEDIUM FOR IMAGE FORMING APPARATUS

(71) Applicant: BROTHER KOGYO KABUSHIKI KAISHA, Nagoya, Aichi (JP)

(72) Inventor: Tatsuya Koyama, Toyoake (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/696,567

(22) Filed: Apr. 27, 2015

(65) Prior Publication Data

US 2015/0316879 A1 Nov. 5, 2015

(30) Foreign Application Priority Data

Apr. 30, 2014 (JP) ..... 2014-093872

(51) Int. Cl.
*G03G 15/20* (2006.01)

(52) U.S. Cl.
CPC ..... *G03G 15/2039* (2013.01); *G03G 15/2017* (2013.01)

(58) Field of Classification Search
CPC ..... G03G 15/2039; G03G 15/2017
USPC ..... 399/69
See application file for complete search history.

(56) References Cited

U.S. PATENT DOCUMENTS

2007/0217810 A1* 9/2007 Minagawa ..... G03G 15/2039 399/69

FOREIGN PATENT DOCUMENTS

| | | | |
|---|---|---|---|
| JP | 2003-149983 | A | 5/2003 |
| JP | 2004-013058 | A | 1/2004 |
| JP | 2009-128425 | A | 6/2009 |

* cited by examiner

*Primary Examiner* — Quana M Grainger
(74) *Attorney, Agent, or Firm* — Scully, Scott, Murphy & Presser, PC

(57) ABSTRACT

An image forming apparatus, including an image forming unit, a fixing unit with a heater, an end temperature sensor to detect a temperature in an end area an end area of the fixing unit, and a controller, is provided. The controller is configured to perform a width obtaining step to obtain the width of the sheet, a temperature obtaining step to obtain the detected temperature of the fixing unit, a comparison step to compare the detected temperature with a threshold, a cooling step to let the end area of the fixing unit cool down when the detected temperature is one of higher and equal to the threshold, and a threshold-setting step to set one of a first value and a second value to be the threshold depending on the width of the sheet obtained in the width obtaining step.

17 Claims, 10 Drawing Sheets

IMAGE FORMING APPARATUS WITH A HEAT-CONTROLLABLE FIXING UNIT AND COMPUTER READABLE MEDIUM FOR IMAGE FORMING APPARATUS

CROSS REFERENCE TO RELATED APPLICATION

This application claims priority from Japanese Patent Application No. 2014-093872 filed on Apr. 30, 2014, the entire subject matter of which is incorporated herein by reference.

BACKGROUND

1. Technical Field

An aspect of the present invention relates to an image forming apparatus with a fixing unit, a method to control the image forming apparatus, and a computer readable medium to store a computer readable program to control the image forming apparatus.

2. Related Art

An image forming apparatus having a fixing unit, in which an image formed in a developer agent on a sheet is thermally fixed thereon, is known. The fixing unit may include a heating member to convey heat to the sheet, a heater to heat the heating member, and a heat sensor to detect a temperature in the heating member. In particular, the heat sensor may detect a temperature in an outer part of the heating member, which is laterally outside a pathway for the sheet being conveyed.

In the conventional fixing unit, heat in the heating member in an inner part coincident with the pathway for the sheet may be absorbed by the sheet being conveyed, while heat in the outer part of the heating member coincident with the laterally outside area of the pathway may accumulate. As the image forming apparatus continues forming images, the outer part of the heating member coincident with the laterally outside area of the pathway may be heated excessively. Therefore, the image forming apparatus may take an action to switch the heater off and abort feeding sheets when the heat sensor detects the temperature in the outer part of the heating member being higher than a predetermined degree so that the heating member may be prevented from being overheated in the outer part.

SUMMARY

According to the known image forming apparatus mentioned above, when a width of the sheet being conveyed is greater, the heat in the outer part of the heating member may tend to be absorbed by the sheet; therefore, the heat may accumulate in a smaller range in the heating member compared to the heating member when the width of the sheet being conveyed is smaller, and influence of the accumulated heat on neighboring parts in the vicinity of the outer part of the heating member may be less. Meanwhile, according to the known image forming apparatus mentioned above, the action to prevent overheat in the outer part of the heating member may be taken regardless of the width of the sheet. In other words, even when the width of the sheet being conveyed is greater, and when a smaller range of the heating member is subject to the increase of the temperature, the action to lower the temperature in the outer part of the heating member may be taken.

The present invention is advantageous in that an image forming apparatus, in which the temperature in the outer part of the heating member may be lowered depending on the width of the sheet being conveyed, is provided. Further, a method to control the image forming apparatus, and a computer usable storage device to store a program to control the image forming apparatus are provided.

According to an aspect of the present invention, an image forming apparatus, including an image forming unit configured to form an image in a developer agent on a sheet; a fixing unit including a heater and being configured to fix the image in the developer agent on the sheet; an end temperature sensor disposed on an end area of the fixing unit with regard to a direction of width of the sheet; and a controller, is provided. The controller is configured to perform a width obtaining step, in which the controller obtains the width of the sheet; a temperature obtaining step, in which the controller obtains a temperature of the fixing unit detected by the end temperature sensor; a comparison step, in which the controller compares the detected temperature with a threshold; a cooling step, in which the controller manipulates the heater to let the end area of the fixing unit cool down when the temperature detected by the end temperature sensor is one of higher and equal to the threshold; and a threshold-setting step, in which the controller sets a first value to be the threshold when the width of the sheet obtained in the width obtaining step is one of greater and equal to a predetermined width, and in which the controller sets a second value being different from the first value to be the threshold when the width of the sheet obtained in the width obtaining step is smaller than the predetermined width.

According to another aspect of the present invention, a method configured to be implemented on a processor to control an image forming apparatus, which includes an image forming unit to form an image in a developer agent on a sheet; a fixing unit including a heater and being configured to fix the image in the developer agent on the sheet; and an end temperature sensor disposed on an end area of the fixing unit with regard to a direction of width of the sheet, is provided. The method includes a width obtaining step, in which the controller obtains the width of the sheet; a temperature obtaining step, in which the controller obtains a temperature of the fixing unit detected by the end temperature sensor; a comparison step, in which the controller compares the detected temperature with a threshold; a cooling step, in which the controller manipulates the heater to let the end area of the fixing unit cool down when the temperature detected by the end temperature sensor is one of higher and equal to the threshold; and a threshold-setting step, in which the controller sets a first value to be the threshold when the width of the sheet obtained in the width obtaining step is one of greater and equal to a predetermined width, and in which the controller sets a second value being different from the first value to be the threshold when the width of the sheet obtained in the width obtaining step is smaller than the predetermined width.

According to still another aspect of the present invention, a non-transitory computer readable medium storing computer readable instructions that are executable by a computer to control an image forming apparatus, when executed by the computer, is provided. While the image forming apparatus includes an image forming unit to form an image in a developer agent on a sheet, a fixing unit including a heater and being configured to fix the image in the developer agent on the sheet, and an end temperature sensor disposed on an end area of the fixing unit with regard to a direction of width of the sheet, the computer readable instructions are configured to cause the computer to control the image forming apparatus by performing a width obtaining step, in which the controller obtains the width of the sheet; a temperature obtaining step, in which the controller obtains a temperature of the fixing unit detected by the end temperature sensor; a comparison step, in which the controller compares the detected temperature with a threshold; a cooling step, in which the controller manipulates the heater to let the end area of the fixing unit cool down when the temperature detected by the end temperature sensor is one of higher and equal to the threshold; and a threshold-setting step, in which the controller sets a first value to be the threshold when the width of the sheet obtained in the width obtaining step is one of greater and equal to a predetermined width, and in which the controller sets a second value being different from the first value to be the threshold when the width of the sheet obtained in the width obtaining step is smaller than the predetermined width.

BRIEF DESCRIPTION OF THE ACCOMPANYING DRAWINGS

DETAILED DESCRIPTION

Hereinafter, an exemplary configuration of a laser printer 1 according to an embodiment of the present invention will be described with reference to the accompanying drawings. First, an overall configuration of the laser printer 1 will be described, and second, detailed configurations of a fixing unit and a controller in the laser printer 1 will be described.

Figure 1:
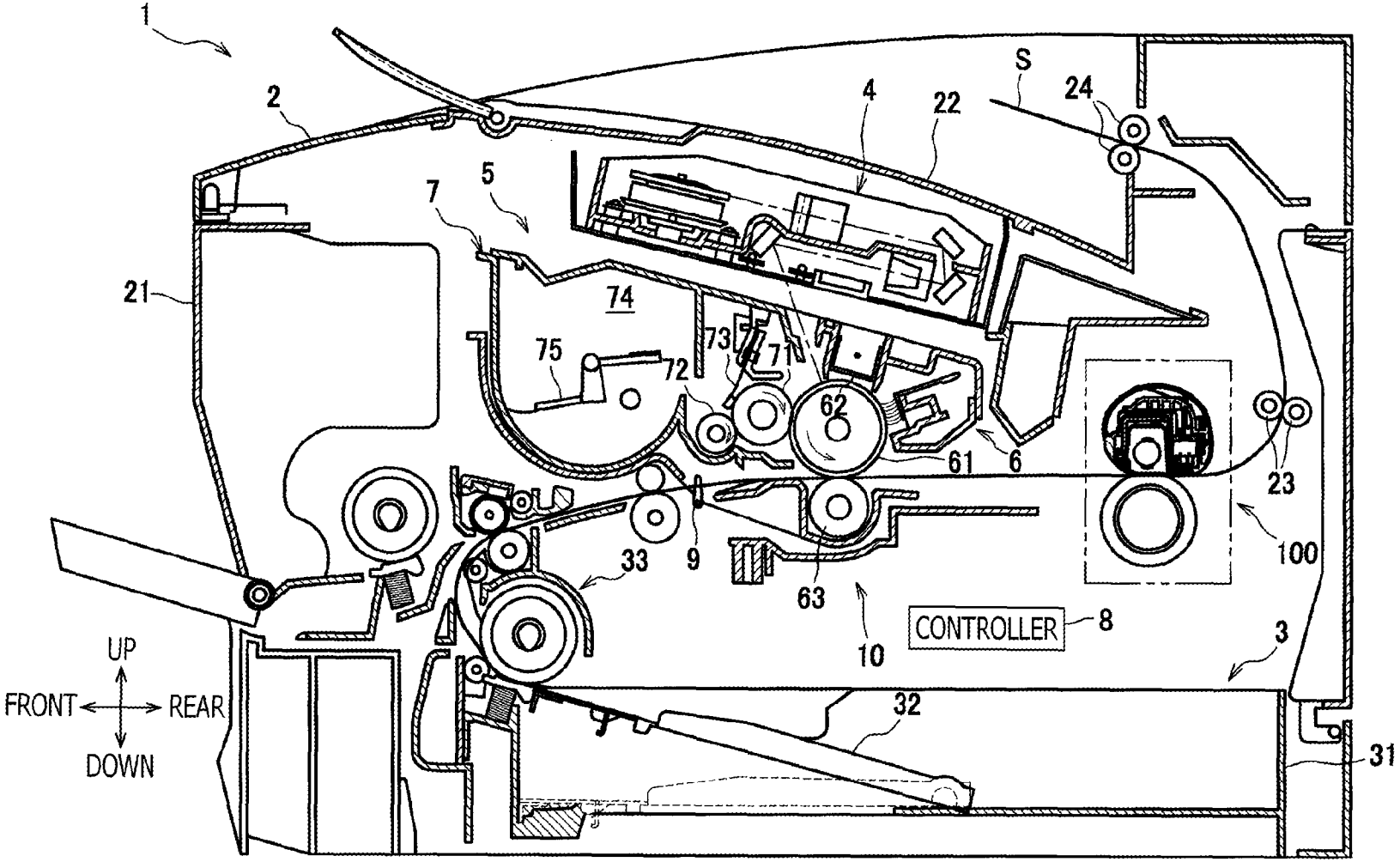
FIG. 1 is an illustrative cross-sectional view of a laser printer according to an embodiment of the present invention.

In the following description, directions concerning the laser printer 1 will be referred to in accordance with a user's ordinary position to use the laser printer 1, as indicated by arrows. For example, a viewer's left-hand side appearing in FIG. 1 is referred to as a front side of the laser printer 1, and a right-hand side in FIG. 1 opposite from the front side is referred to as a rear side. A side which corresponds to the viewer's nearer side is referred to as a right-hand side for the user, and an opposite side from the right, which corresponds to the viewer's farther side is referred to as a left-hand side for the user. An up-down direction in FIG. 1 corresponds to a vertical direction of the laser printer 1. Further, the right-to-left or left-to-right direction of the laser printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2A, 2B, 3-4 and 10A, 10B are similarly based on the orientation of the laser printer 1 as defined above and correspond to those with respect to the laser printer 1 shown in FIG. 1 even when the drawings are viewed from different angles.

As shown in FIG. 1, the laser printer 1 includes a feeder unit 3 to feed sheets S, an image forming unit 10 to form toner images on the sheets S, a fixing unit 100 to thermally fix the images on the sheets S, and a controller 8, which are accommodated in a main chassis 2.

The feeder unit 3 is disposed in a lower position in the chassis 2 and includes a feeder tray 31 and a feeder device 33.

The feeder tray 31 is a top-open box to accommodate the sheets S and is attachable to the main chassis 2. The feeder tray 31 may be pulled forward to be drawn out of the main chassis 2 and pushed rearward to be attached to the main chassis 2.

Figure 2A:
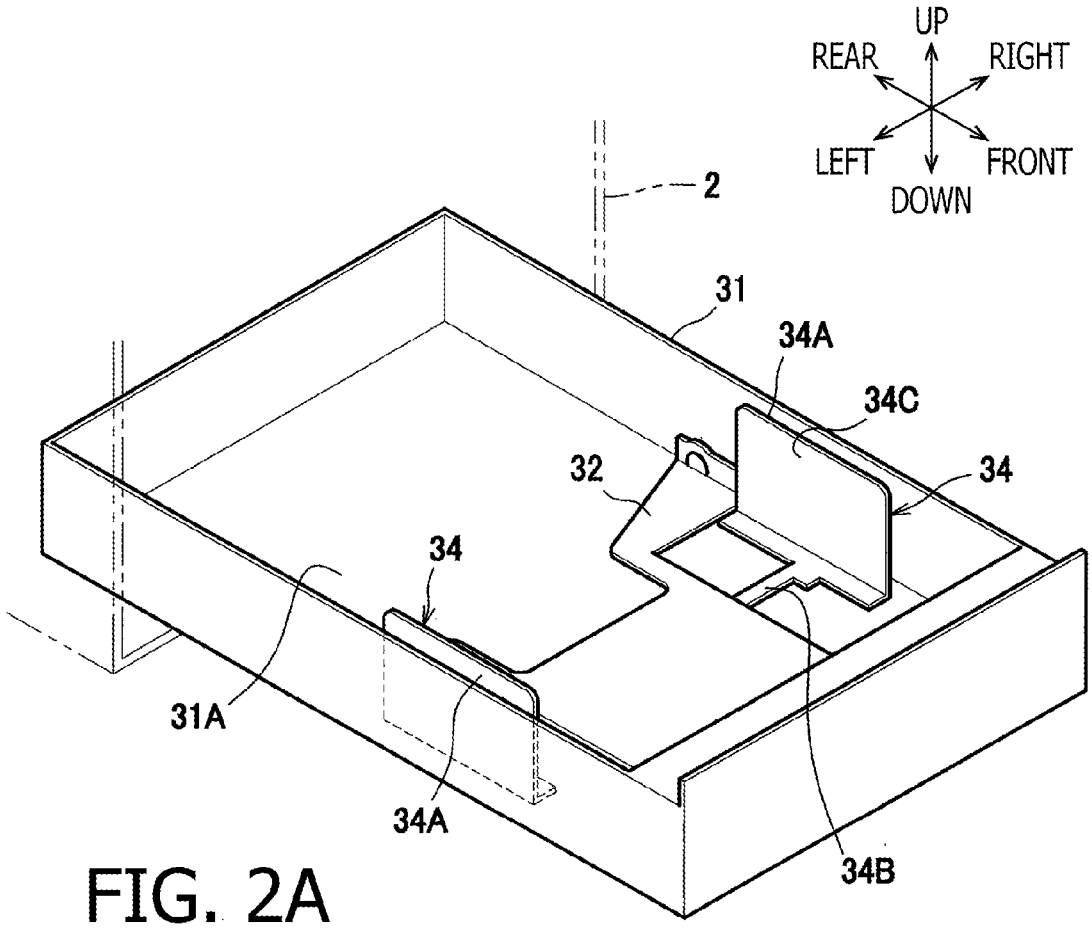
FIG. 2A is a perspective view of a feeder tray in the laser printer according to the embodiment of the present invention.

The feeder tray 31 includes, as shown in FIG. 2A, a bottom 31A, on which the sheets S are stacked, a sheet-pressing board 32, and a pair of side-guides 34, which are arranged on the bottom 31A.

The sheet-pressing board 32 is swingably supported at a rear end thereof by the feeder tray 31. When a front end of the sheet-pressing board 32 moves upward, the sheets S stored in the feeder tray 31 are uplifted.

Figure 2B:
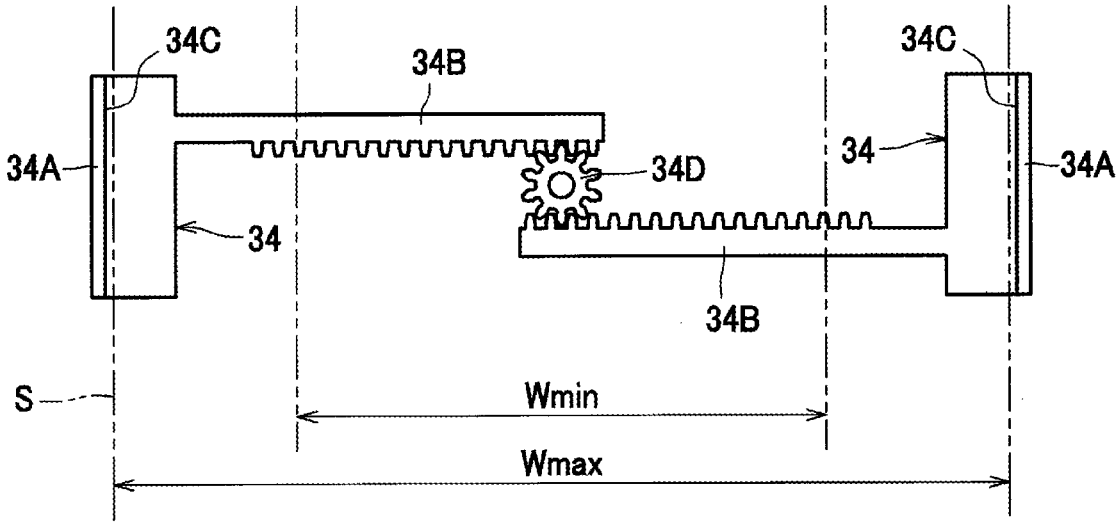
FIG. 2B is a plan view of a side-guide in the laser printer according to the embodiment of the present invention.

The pair of side-guides 34 are arranged in the feeder tray 31 to face with each other along a direction of width of the sheets S, i.e., along the widthwise direction, across the sheets S (see FIG. 2B). Each side-guide 34 includes a guide fence 34A and a rack gear 34B, and is movable along the widthwise direction.

Each guide fence 34A stands vertically and has a restrictive face 34C, which faces inward with regard to the widthwise direction. While the guide fences 34A are arranged to be spaced apart from each other along the widthwise direction and placed to contact widthwise ends of the sheets S, a position of the sheets with regard to the widthwise direction is restricted.

As shown in FIG. 2B, each rack gear 34B is formed to extend inward from a lower part of the guide fence 34A along the widthwise direction. The rack gear 34B is formed to have gear teeth on a side that faces the other rack gear 34B, and the gear teeth are meshed with a pinion gear 34D, which is arranged on the feeder tray 31 at an intermediate position between the rack gears 34B. The pinion gear 34D links the paired side-guides 34 to be movable in conjunction with each other. Thereby, when one of the paired side-guides 34 is moved along the widthwise direction to fit with the widthwise end of the sheets S, the other of the paired side-guides 34 is moved along symmetrically in the widthwise direction. Thus, the paired side-guides 34 are arranged on each widthwise side of the sheets S to restrict a position of the sheets S interposed there-between and gather the sheets S at a widthwise center in the feeder tray 31.

The paired side-guides 34 are, when widened to a maximum width, i.e., when placed at outermost positions along the widthwise direction, capable of restricting the position of the sheets S with a maximum width usable in the laser printer 1. Meanwhile, when narrowed to a minimum width, i.e., when placed at innermost positions along the widthwise direction, the paired side-guides 34 are capable of restricting the position of the sheets S with a minimum width usable in the laser printer 1. In other words, when the paired side-guides 34 are widened at the maximum width, the restrictive faces 34C are placed in positions corresponding to widthwise ends of a maximum-width sheet pathway Wmax, which is an area for the sheet S with the maximum width is allowed to pass through, and when the paired side-guides 34 are narrowed at the minimum width, the restrictive faces 34 are placed in positions corresponding to widthwise ends of a minimum-width sheet pathway Wmin, which is an area for the sheet S with the minimum width is allowed to pass through.

In the feeder unit 3 configured as above, the sheets S stored in the feeder tray 31 are uplifted by the sheet-pressing board 32 and fed to the image forming unit 10 by the feeder device 33.

Referring back to FIG. 1, the image forming unit 10 includes an exposure device 4 and a processing cartridge 5.

The exposure device 4 is disposed in an upper position in the main chassis 2 and includes a laser emitter (not shown), a polygon mirror (unsigned), lenses (unsigned), and reflection mirrors (unsigned). In the exposure device 4, a laser beam is emitted from the laser emitter and transmitted to a surface of a photosensitive drum 61 in the processing cartridge 5 via the polygon mirrors, the lenses, and the reflection mirrors to scan the surface of the photosensitive drum 61.

The processing cartridge 5 is disposed in a position between the exposure device 4 and the feeder tray 31. The processing cartridge 5 is detachably attached to the main chassis 2 through an opening (unsigned), which is exposed or covered by a front cover 21, while the front cover 21 is pivotable on a front side of the main chassis 2. The processing cartridge 5 includes a drum unit 6 and a developer unit 7.

The drum unit 6 includes the photosensitive drum 61, a charger 62, and a transfer roller 63. The developer unit 7 is removably attached to the drum unit 6 and includes a developer roller 71, a supplier roller 72, a toner-spreader blade 73, a toner container 74 to store toner, and an agitator 75 to agitate the toner in the toner container 74.

In the processing cartridge 5, as the photosensitive drum 61 rotates, a surface of the photosensitive drum 61 is electrically charged evenly by the charger 62 and partly exposed to the laser beam emitted from the exposure device 4 so that electrical charges of the areas exposed to the laser beam are lowered and a latent image according to image data is formed to be carried on the surface of the photosensitive drum 61. Meanwhile, the toner in the toner container 74 is supplied to the developer roller 71 by the supplier roller 72 and enters a position between the developer roller 71 and the toner-spreader blade 73 to be spread on the developer roller 71 to form an evenly-thinned layer.

Meanwhile, the toner on the developer roller 71 is supplied to the latent image on the photosensitive drum 61 while the developer roller 71 is rotated so that the latent image on the photosensitive drum 61 is developed to be a toner image. In the meantime, as the sheet S is conveyed through an intermediate position between the photosensitive drum 61 and the transfer roller 63, the toner image carried on the surface of the photosensitive drum 61 is transferred onto the sheet S.

The fixing unit 100 is disposed in a rearward position with respect to the processing cartridge 5, and the toner image transferred to the sheet S is thermally fixed on the sheet S as the sheet S passes through the fixing unit 100. Thereafter, the sheet S is ejected by conveyer rollers 23, 24 to a sheet outlet 22.

Figure 3:
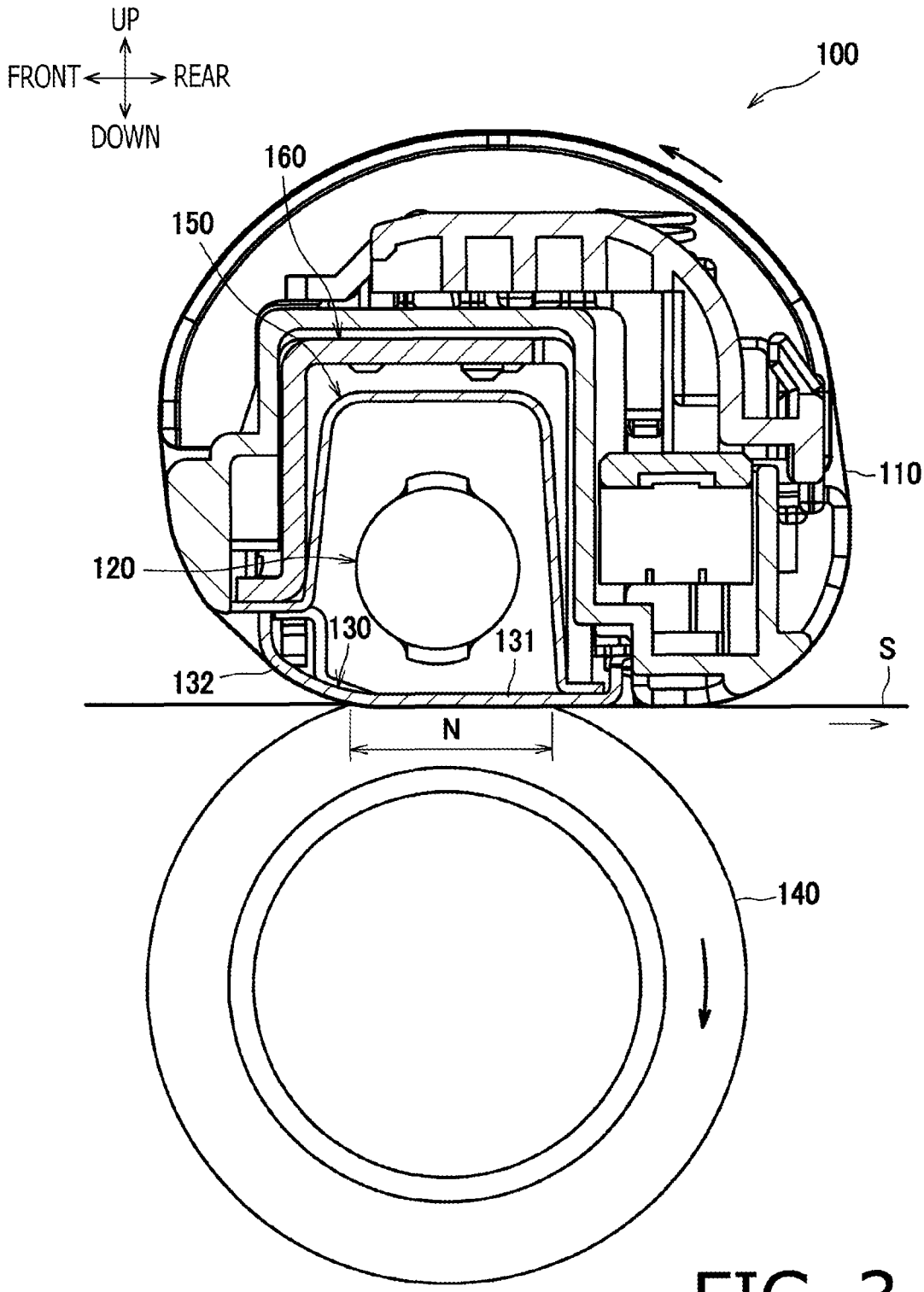
FIG. 3 is a cross-sectional view of a fixing unit in the laser printer according to the embodiment of the present invention.

As shown in FIG. 3, the fixing unit 100 includes a fixing belt 100, a heater 120, a nipper board 130, a pressure roller 140, a reflector board 150, and a stay 160.

The fixing belt 110 transmits heat to the sheet S having the toner images. The fixing belt 110 is an endless belt made of a stainless steel with a heat-resistance property and flexibility. Inside the fixing belt 110, arranged are the heater 120, the nipper board 130, the reflector board 150, and the stay 160.

The heater 120 may be, for example a halogen lamp, and radiates heat to warm the nipper board 130 and the fixing belt 100. The heater 120 is disposed in a position spaced apart for a predetermined distance from an inner surface of the nipper board 130.

Figure 4:
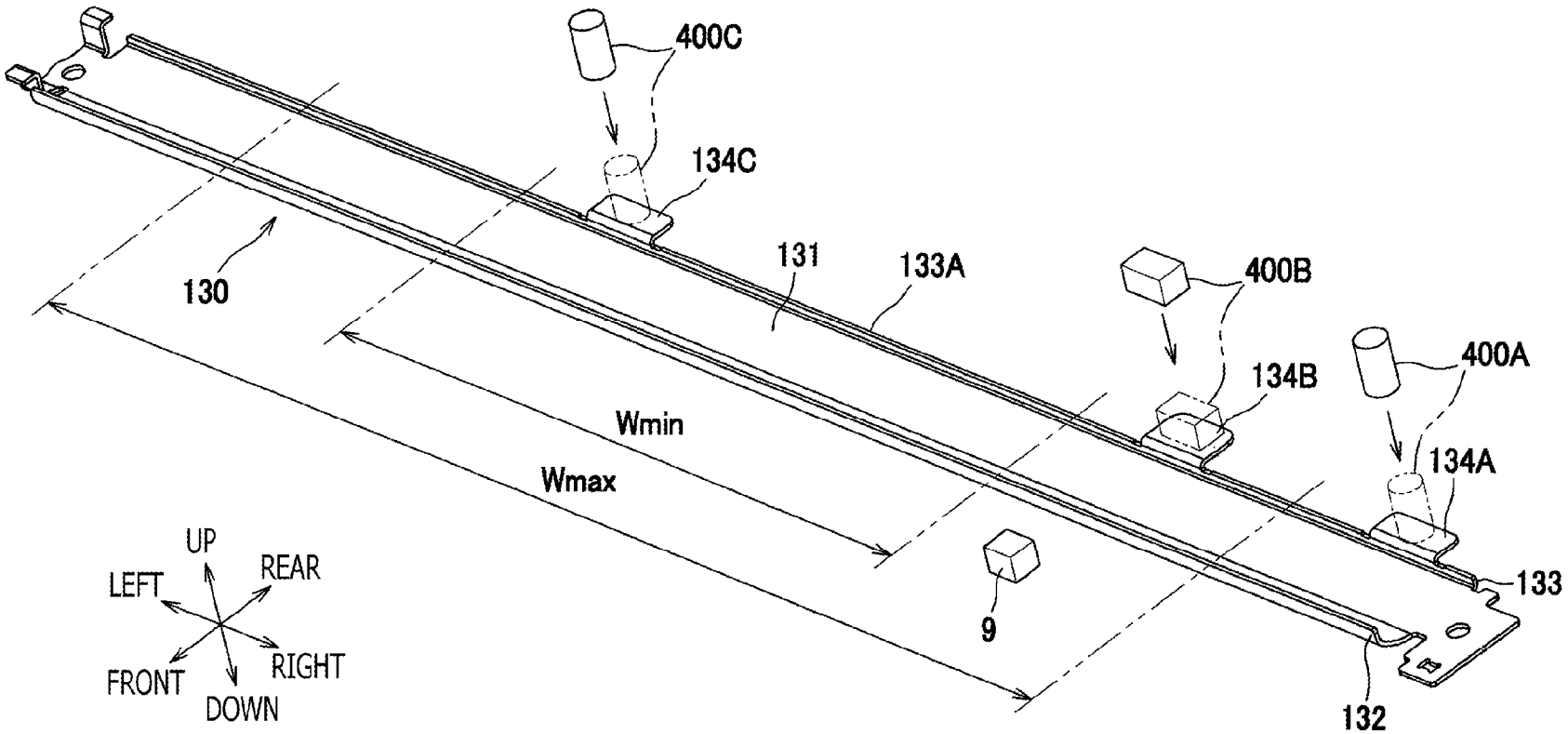
FIG. 4 is a perspective view of a nipper plate, a side thermistor, a thermostat, a central thermistor, and a sheet sensor in the laser printer according to the embodiment of the present invention.

The nipper board 130 is disposed to slidably contact an inner circumferential surface of the fixing belt 110. The nipper board 130 is arranged to be exposed to the heat from the heater 120 and conducts the heat to the fixing belt 110. The nipper board 130 may be a bent-formed aluminum board having a higher heat conductivity than, for example, the stay 160, which may be made of stainless steel. The nipper board 130 includes, as shown in FIG. 4, a straight part 131, a front bent-part 132, a rear bent-part 133, and three (3) detectable parts, which are first detectable part 134A, a second detectable part 134B, and a third detectable part 134C. The straight part 131 is elongated along the widthwise direction and arranged to contact the fixing belt 110. The front bent-part 132 extends upward from a front end of the straight part 131, and the rear bent-part 133 extends upward from a rear end of the straight part 131.

The first, second, and third detectable parts 134A, 134B, 134C are pieces, on which a side thermistor 400A, a thermostat 400B, and a central thermistor 400C are placed respectively. The first, second, and third detectable parts 134A, 134B, 134C are formed to extend rearward from an upper edge 133A of the rear bent-part 133.

The first detectable part 134A, which is in a rightmost position among the three detectable parts 134A, 134B, 134C, is formed on a rightward end of the nipper board 130 to be arranged laterally outside the maximum-width sheet pathway Wmax with regard to the widthwise direction. The second detectable part 134B is formed in a leftward position with regard to the first detectable part 134A, inside the maximum-width sheet pathway Wmax, and laterally outside the minimum-width sheet pathway Wmin, with regard to the widthwise direction. The third detectable part 134C is formed in a widthwise central position in the nipper board 130 and inside the minimum-width sheet pathway Wmin, with regard to the widthwise direction.

The side thermistor 400A to detect temperature is arranged to contact the first detectable part 134A. In other words, the side thermistor 400A is disposed laterally outside the maximum-width sheet pathway Wmax with regard to the widthwise direction. The side thermistor 400A is disposed on an outer side of the restrictive face 34C (see FIG. 2B) of the side-guide 34 in the feeder tray 31 with regard to the widthwise direction.

The side thermistor 400A is configured to output a signal corresponding to a temperature in the first detectable part 134A to the controller 8. Therefore, a temperature in the fixing belt 110 at a rightward end, more specifically, a part of the fixing belt 110 outside the maximum-width sheet pathway Wmax with regard to the widthwise direction, may be indirectly detected by the side thermistor 400A through the first detectable part 134A.

The thermostat 400B is disposed to contact the second detectable part 134B. In other words, the thermostat 400B is disposed laterally inside the maximum-width sheet pathway Wmax and laterally outside the minimum-width sheet pathway Wmin with regard to the widthwise direction.

The thermostat 400B detects a temperature in the second detectable part 134B, when a temperature in a part of the fixing belt 110 corresponding to the second detectable part 134B is increased to be greater than or equal to a third threshold, which will be described later in detail, and shuts down electricity to the heater 120 without being controlled by the controller 8.

The central thermistor 400C is disposed on the third detectable part 134C. In other words, the center thermistor 400C is disposed inside the minimum-width sheet pathway Wmin with regard to the widthwise direction.

The central thermistor 400C is configured to output a signal corresponding to a temperature in the third detectable part 134C to the controller 8. Therefore, a temperature in a part of the fixing belt 110 inside the minimum-width sheet pathway Wmax with regard to the widthwise direction may be indirectly detected by the central thermistor 400C through the third detectable part 134C.

In a position upstream of the nipper board 130 with regard to a direction to convey the sheet S, disposed is a sheet sensor 9. The sheet sensor 9 is disposed laterally outside the minimum-width sheet pathway Wmin and laterally inside the maximum-width sheet pathway Wmax with regard to the widthwise direction. The sheet sensor 9 may be, for example, in a same position as the thermostat 400B along the widthwise direction. The sheet sensor 9 is configured to output different signals depending on presence or absence of the sheet S at a position corresponding to the sheet sensor 9.

Referring back to FIG. 3, the pressure roller 140 is arranged in a lower position with regard to the nipper board 130 and forms a nipping section N to nip the fixing belt 110 in conjunction with the straight part 131 of the nipper board 130. In order to nip the fixing belt 110 in the nipping section N, one of the nipper board 130 and the pressure roller 140 is urged against the other of the nipper board 130 and the pressure roller 140. The pressure roller 140 is driven to be rotated by a driving force from a driving source, which is disposed in the main chassis 2 but not shown. With the fixing belt 110 and the sheet S nipped between the pressure roller 140 and the nipper board 130, when the pressure roller 140 is driven to rotate, the fixing belt 110 is rolled along with the rotation of the pressure roller 140, and the sheet S is conveyed rearward.

The reflector board 150 is a board, which has a characteristic of a higher reflection rate for infrared and far-infrared rays, to reflect the radiation heat from the heater 120 toward the nipper board 130 and may be, for example, an aluminum board. The reflector board 150 is formed in curve to have a cross-sectional approximate shape of a U, which surrounds the heater 120, inside the belt 110.

The stay 160 supports the nipper board 130 through the reflector board 150 to bear the pressure from the pressure roller 140. The stay 160 is arranged to surround the heater 120 and the reflector board 150 inside the fixing belt 110. The stay 160 may be, for example, a stainless sheet, which has greater rigidity than the nipper board 130. Thus, the nipper board 130 may be restrained from being deformed by the pressure from the pressure roller 140.

The controller 8 (see FIG. 8) is a computing device which includes a central processing unit (CPU), a read-only memory (ROM), and a random access memory (RAM) (not shown). The controller 8 is configured to execute a cooling operation, according to the output from the side thermistor 400A and a preinstalled program, to let a lateral end area of the fixing belt 110 cool down when a temperature in the lateral end area of the fixing belt is at a threshold TA.

Figure 5:
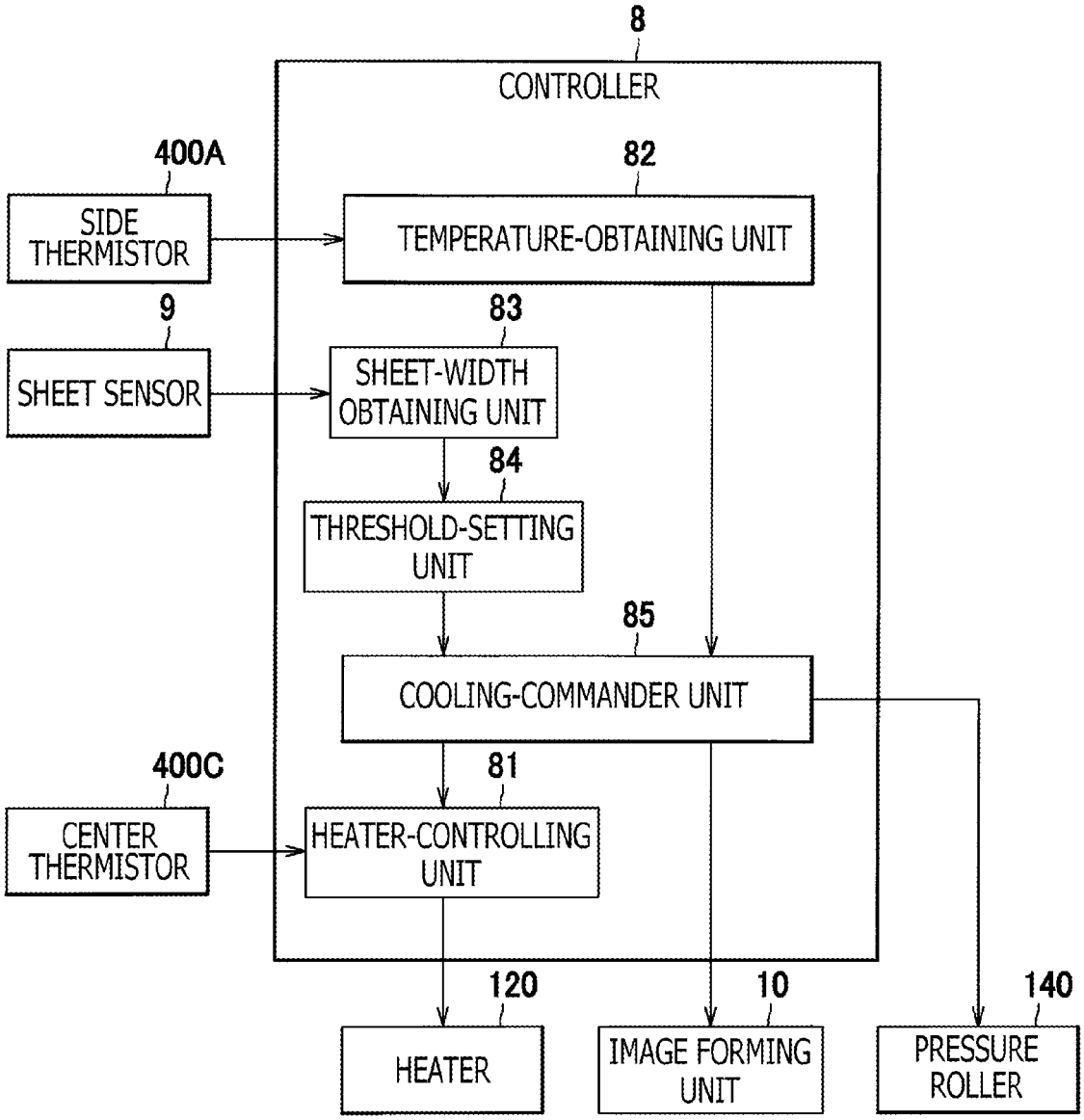
FIG. 5 is a block chart to illustrate a configuration of a controller and related components in the laser printer according to the embodiment of the present invention.

The controller 8 includes, as shown in FIG. 5, a heater-controlling unit 81, a temperature-obtaining unit 82, a sheet-width obtaining unit 83, a threshold-setting unit 84, and a cooling-commander unit 85.

The heater-controlling unit 81 is configured to control the heater 120, according to the output from the central thermistor 400C, to maintain the temperature in a widthwise central area of the fixing belt 110 at a predetermined fixing temperature TF.

The temperature-obtaining unit 82 is configured to obtain a temperature T in a rightward end area of the fixing belt 110 according to the output from the side thermistor 400A.

The sheet-width obtaining unit 83 is configured to execute an obtaining operation, according to the output from the sheet sensor 9, to obtain a width W of the sheet S being conveyed. For example, in the obtaining operation, the sheet-width obtaining unit 83 may determine that the width W of the sheet S being conveyed is greater than or equal to a predetermined width WA when the sheet sensor 9 detects the sheet S and that the width W of the sheet S being conveyed is smaller than the predetermined width WA when the sheet sensor 9 does not detect the sheet S. The obtaining operation may be executed at a predetermined timing, in which the sheet S being conveyed passes through the position corresponding to the sheet sensor 9.

Optionally, the sheet-width obtaining unit 83 may determine the width W of a first sheet S being conveyed based on information concerning the sheet S, which may be input by the user, and the width W of a second and succeeding sheets S being conveyed based on the output from the sheet sensor 9.

The threshold-setting unit 84 is configured to execute a threshold-setting operation, in which a first threshold T1 is set to be the threshold TA when the width W of the sheet S obtained in the obtaining operation is greater than or equal to the predetermined width WA, and a second threshold T2 is set to be the threshold TA when the width W of the sheet S obtained in the obtaining operation is smaller than the predetermined width WA. In this regard, the second threshold T2 is smaller than the first threshold T1. In the meantime, the above-mentioned third threshold is greater than the second threshold T2 and smaller than the first threshold T1.

The cooling-commander unit 85 is configured to execute a cooling-commander operation, in which a command to execute the cooling operation is issued when the temperature T in the rightward end area of the fixing belt 110 obtained by the temperature-obtaining unit 82 is greater than or equal to the threshold TA. Upon executing the cooling operation, the cooling-commander unit 85 may issue a command to let the temperature in the central area of the fixing belt 110 be lower than a regular-driving temperature, which is a temperature in the central area of the fixing belt 110 when the cooling operation is not performed, and to reduce a conveying velocity to convey the sheet S to be lower than a regular-driving velocity, which is a velocity to convey the sheet S when the cooling operation is not performed.

More specifically, when the temperature T in the rightward end area of the fixing belt 110 is determined to be lower than the threshold TA, the cooling-commander unit 85 sets a first fixing temperature TF1 to be a fixing temperature TF and a first conveying velocity V1 to be a conveying velocity VA to convey the sheet S. On the other hand, when the temperature T in the rightward end area of the fixing belt 110 is determined to be higher than or equal to the threshold TA, the cooling-commander unit 85 sets a second fixing temperature TF2, which is lower than the first fixing temperature TF1, to be the fixing temperature TF and a second velocity V2, which is slower than the first velocity V1, to be the conveying velocity VA to convey the sheet S. Further, the cooling-commander unit 85 manipulates the heater-controlling unit 81 to control the heater 120 so that the temperature in the central area of the fixing belt 110 is maintained at the fixing temperature TF. Furthermore, the cooling-commander unit 85 controls the image forming unit 10 and the pressure roller 140 to convey the sheet S at the conveying velocity VA.

Figure 6:
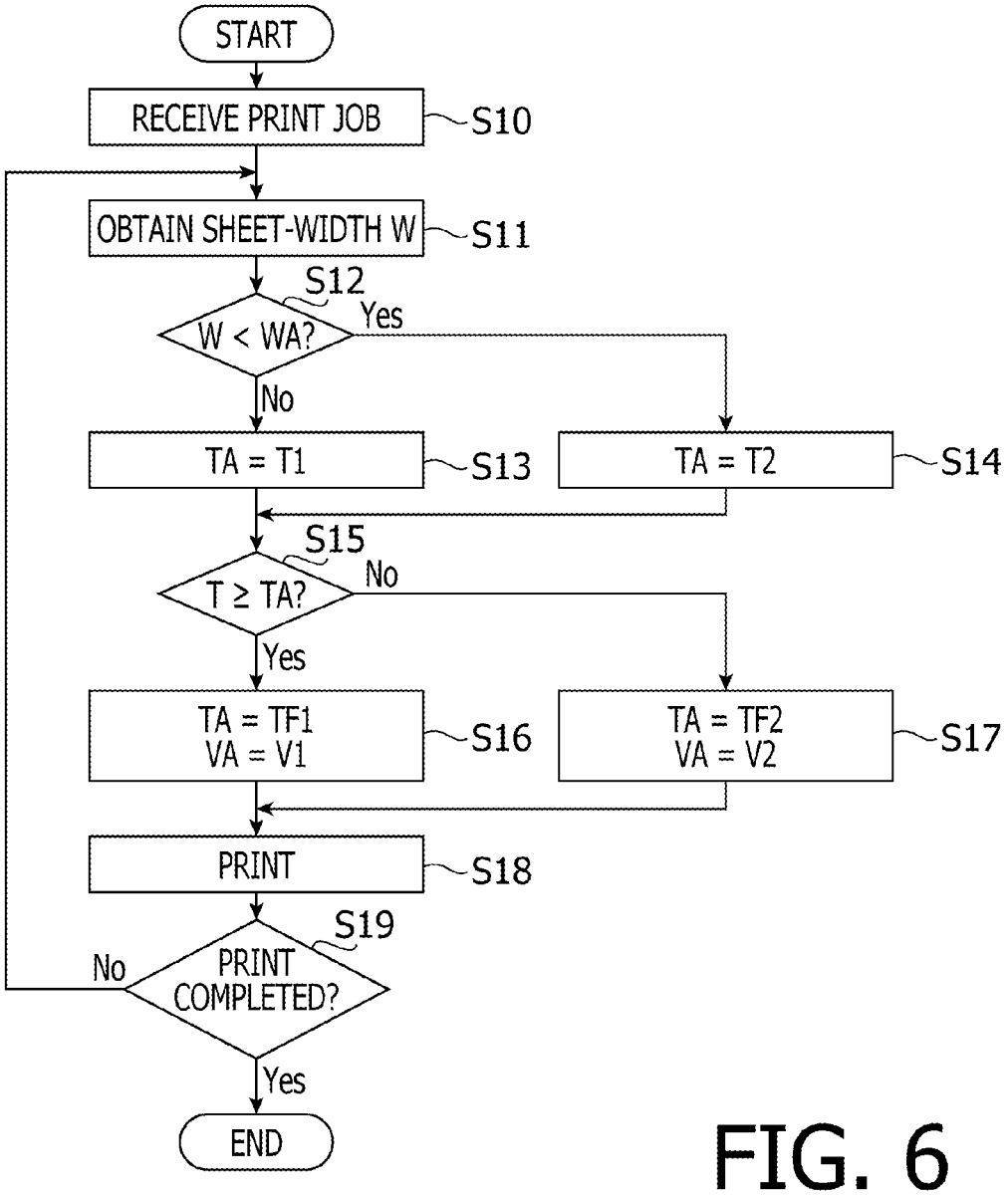
FIG. 6 is a flowchart to illustrate a flow of steps to be taken by the controller in the laser printer according to the embodiment of the present invention.

Next, referring to FIG. 6, detailed behaviors of the controller 8 will be described. When the controller 8 receives a print job (S10), the controller 8 obtains the width W of the sheet S being conveyed (S11).

In S12, the controller 8 determines if the obtained width W of the sheet S is smaller than the predetermined width WA (S12). When the width W of the sheet S being conveyed is determined to be greater than or equal to the predetermined width WA (S12: NO), the controller 8 sets the first threshold T1 to be the threshold TA (S13). On the other hand, when the width W of the sheet S being conveyed is determined to be smaller than the predetermined width WA (S12: YES), the controller 8 sets the second threshold T2 to be the threshold TA (S14).

After setting the threshold TA in S13 or S14, the controller 8 determines if the temperature T in the rightward end of the fixing belt 110 detected by the side thermistor 400A is higher than or equal to the threshold TA (S15).

In S15, when the temperature T of the rightward end of the fixing belt 110 is determined to be lower than the threshold TA (S15: NO), the controller 8 sets the first fixing temperature TF1 to be the fixing temperature TF and the first velocity V1 to be the conveying velocity VA to convey the sheet S (S16). On the other hand, when the temperature T of the rightward end of the fixing belt 110 is determined to be higher than or equal to the threshold TA (S15: YES), the controller 8, more specifically, the cooling-commander unit 85, sets the second fixing temperature TF2 to be the fixing temperature TF and the second velocity V2 to be the conveying velocity VA to convey the sheet S (S17).

After setting the conveying velocity VA to convey the sheet S in S16 or S17, the controller 8 manipulates the feeder unit 3 to convey the sheet S at the conveying velocity VA and the image forming unit 10 to form the image based on the print job (S18). After forming a first page of the print job, the controller 8 determines if the print job should end thereat (S19). When the print job is determined to end thereat (S19: YES), the controller 8 finishes the printing operation. On the other hand, when the print job is determined to be continued (S19: NO), the controller 8 returns to S11 and continues the print job.

According to the laser printer 1 configured as above, when the sheet S passes through the fixing unit 100, the sheet S absorbs the heat in the fixing belt 110. Therefore, a temperature in the part of the fixing belt 110 that contacts the sheet S is lowered. When the temperature in the fixing belt 100 is lowered, the heater-controlling unit 81 in the controller 8 manipulates the heater 120 to heat the fixing belt 110 so that the temperature in the central area of the fixing belt 110 is maintained at the first fixing temperature TF1. In this regard, however, in lateral end areas of the fixing belt 110, where the sheet S being conveyed does not contact, the heat is not absorbed by the sheet S but accumulates. Therefore, the temperature in the lateral end areas may increase to be higher than the central part, where the sheet S being conveyed contacts.

As the temperature in the lateral end areas increases, when the side thermistor 400 detects the temperature T in the rightward end area of the fixing belt 110 being higher than or equal to the threshold TA, the controller 8 activates the cooling operation.

When the cooling operation is performed, the heater 120 is controlled to adjust the temperature T at the central area of the fixing belt 110 to be the second fixing temperature TF 2, which is lower than the first fixing temperature TF1 of the regular-driving temperature. In other words, the output from the heater 120 is reduced. Thus, with the reduced output from the heater 120, the heat to be conducted from the heater 120 to the lateral end areas of the fixing belt 110 may be reduced, and the fixing belt 110 may be restrained from being heated up at the lateral end areas.

In the meantime, while the cooling operation is performed, the sheet S is conveyed at the second velocity V2, which is slower than the first velocity V1 of the regular-driving conveying velocity. Therefore, although the temperature in the fixing belt 110 is at the second fixing temperature TF2, which is lower than the first fixing temperature TF1 being the regular-driving temperature, the toner image may be substantially thermally fixed on the sheet S.

When the width W of the sheet S being conveyed is greater, the heat in a larger area in the fixing belt 110 may be absorbed by the sheet S. Therefore, compared to the sheet S with a smaller width, the heat may accumulate in a smaller area in the fixing belt 110, and influence by the heat on the neighboring parts may be limited. In consideration of that, according to the embodiment described above, the first threshold T1 is set to be the threshold TA when the width W of the sheet S is greater than or equal to the predetermined width WA, while the second threshold T2 being lower than the first threshold T1 is set to be the threshold TA when the width W of the sheet S is smaller than the predetermined width WA. In other words, when the width W of the sheet S is greater than or equal to the predetermined width WA, the cooling operation to let the lateral end areas of the fixing belt 110 cool down may be restrained from being performed.

Further, while the side thermistor 400A is disposed laterally outside the maximum-width sheet pathway Wmax with regard to the widthwise direction, the side thermistor 400A may detect the temperature in the area of the fixing belt 110, in which the temperature is not absorbed by the sheet S, so that the cooling operation may be effectively performed depending on the temperature in the lateral end areas. In other words, the lateral end areas of the fixing belt 110 may be efficiently prevented from being overheated.

Moreover, while the third threshold is set to be higher than the second threshold T2, the cooling operation may be activated before the thermostat 400B shuts down the electricity to the heater 120.

The sheet S passes through the position corresponding to the thermostat 400B when the width W of the sheet S is greater than or equal to the predetermined width WA. Therefore, even when the temperature T in the fixing belt 110 detected by the side thermistor 400A exceeds the third threshold, the temperature in the part of the fixing belt 110 corresponding to the position of the thermostat 400B may not necessarily exceed the third threshold. In this regard, according to the present embodiment, the third threshold is smaller than the first threshold T1. Therefore, it may be prevented that the cooling operation is activated when the thermostat 400B does not shut down the electricity to the heater 120.

Although an example of carrying out the invention has been described, those skilled in the art will appreciate that there are numerous variations and permutations of the image forming apparatus, the method and the program to control the image forming program that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

Next, modified examples of the above embodiment will be described below. In the following examples, items or structures which are the same as or similar to the items or the structures described in the previous embodiment will be referred to by the same reference signs, and description of those will be omitted.

For example, in the threshold-setting operation, the second threshold T2 may not necessarily be set to be the threshold TA each time when the width W of the sheet S obtained in the obtaining operation is smaller than the predetermined width WA. But the controller 8 may set the second threshold T2 to be the threshold TA after holding for a predetermined length of period from a point, at which the width W of the sheet S obtained in the obtaining operation changes from the predetermined width WA or greater to the smaller width which is smaller than the predetermined width WA.

Figure 7:
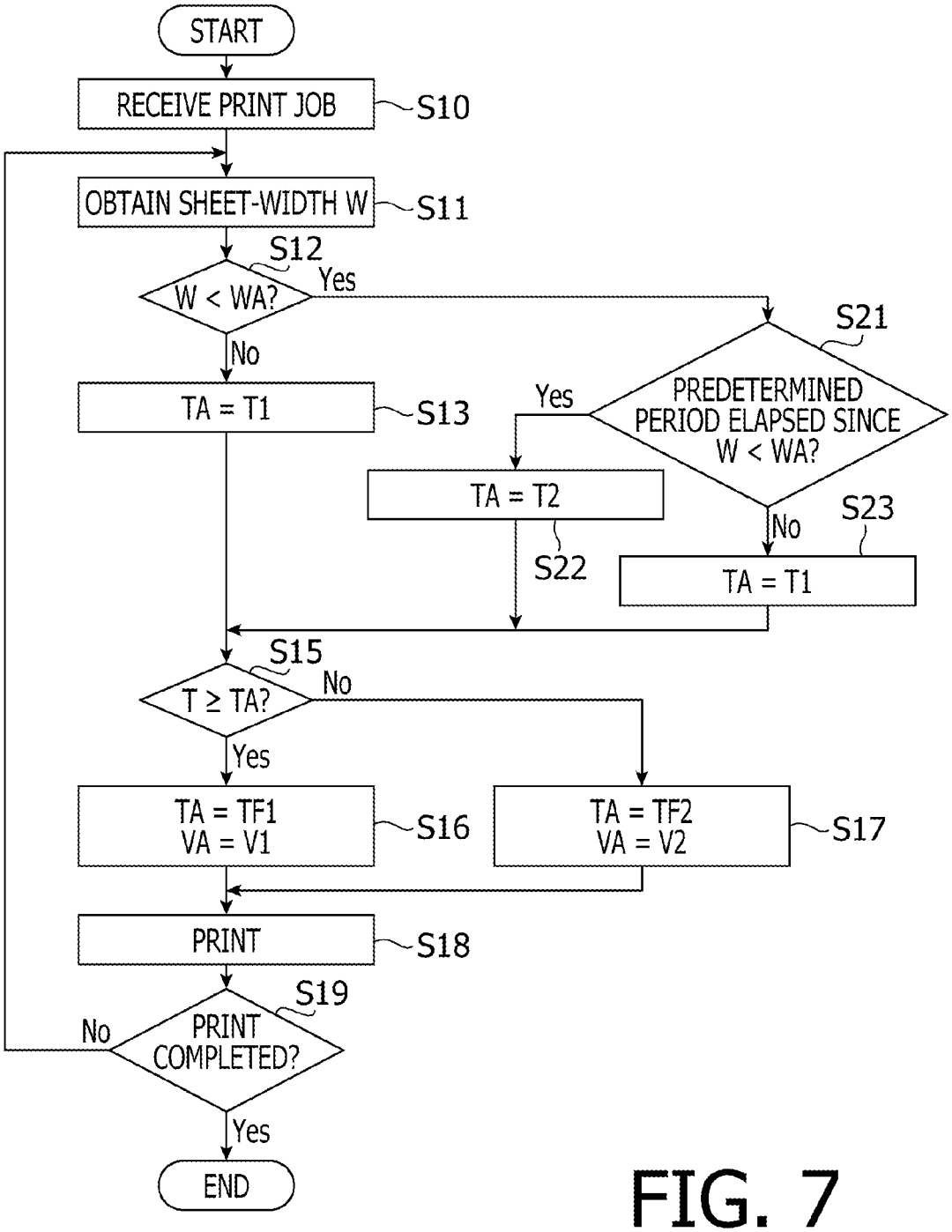
FIG. 7 is a flowchart to illustrate a first modified example of the flow of steps to be taken by the controller in the laser printer according to the embodiment of the present invention.

More specifically, as shown in FIG. 7, in S12, when the controller 8 determines that the width W of the sheet S to be smaller than the predetermined width WA (S12: YES), in S21, the controller 8 may determine if the predetermined length of period elapsed after the width W of the sheet S indicated the smaller width than the predetermined width WA.

In S21, if the controller 8 does not determine that the predetermined length of period elapsed after the width W of the sheet S indicated the smaller width than the predetermined width WA (S21: NO), in S23, the controller 8 may set the first threshold T1 to be the threshold TA. On the other hand, in S21, if the controller 8 determines that the predetermined length of period elapsed after the width W of the sheet S indicated the smaller width than the predetermined width WA (S21: YES), in S22, the controller 8 may set the second threshold T2 to be the threshold TA. After setting the threshold TA in S23 or S22, the flow may proceed to S15.

Thus, by maintaining the threshold TA at the first threshold TA for the predetermined length of period after the width W of the sheet S changes from the greater width to the smaller width, the cooling operation may be prevented from being activated too early after the threshold TA is switched to the smaller value.

For another example, in the threshold-setting process, the threshold TA may be decreased gradually from the first threshold T1 to the second threshold T2 when the width W of the sheet S obtained in the obtaining operation changes from the value greater than or equal to the predetermined width WA to the value smaller than the predetermined width WA.

Figure 8:
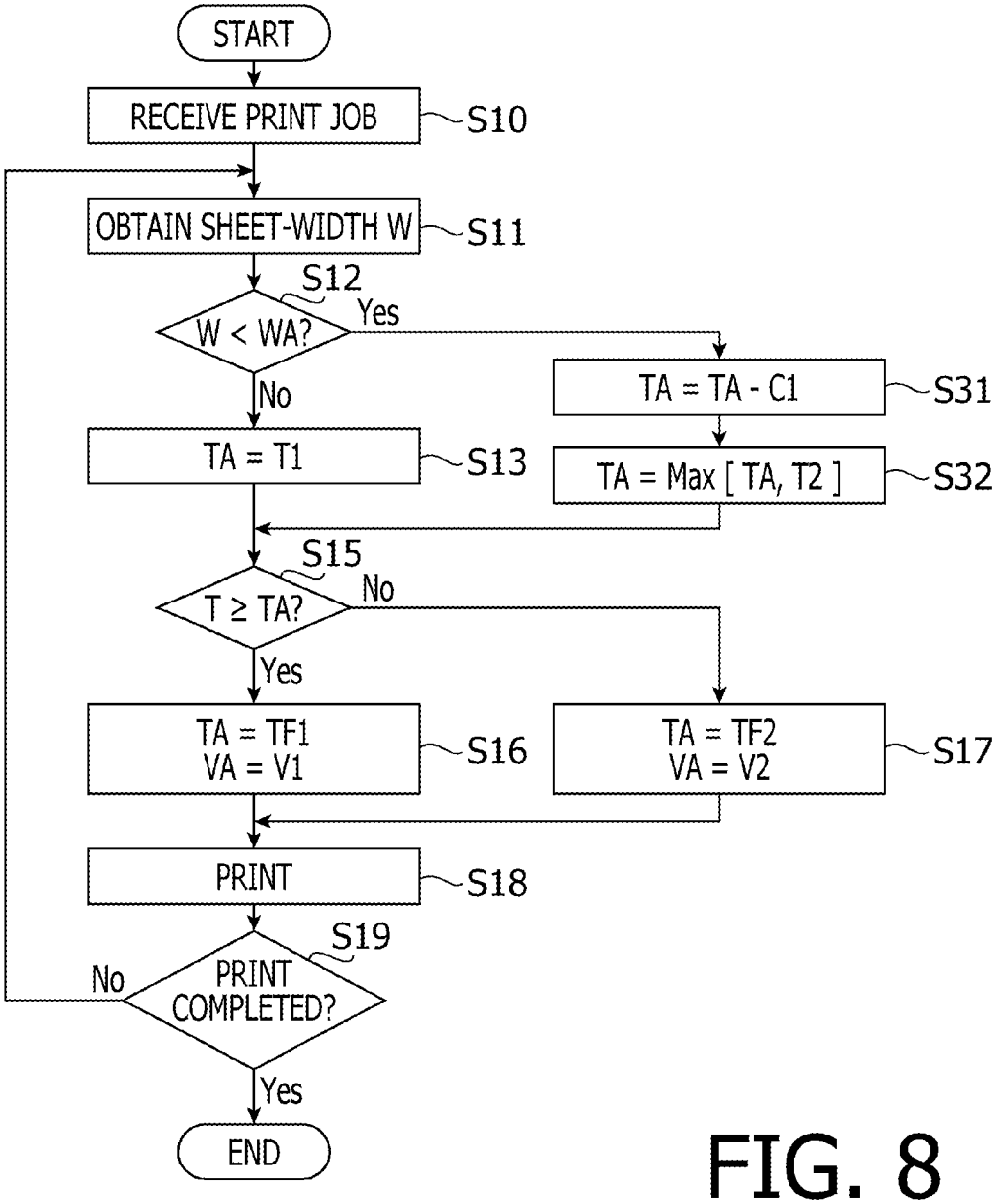
FIG. 8 is a flowchart to illustrate a second modified example of the flow of steps to be taken by the controller in the laser printer according to the embodiment of the present invention.

In particular, as shown in FIG. 8, after determining that the width W of the sheet S is smaller than the predetermined width WA in S12 (S12: YES), in S31, the controller 8 may subtract a constant C1 from the current threshold TA. In S32, the controller 8 may compare the subtracted difference with the second threshold T2 and set a larger value to be a new threshold TA. The flow may thereafter proceed to S15.

Figure 9:
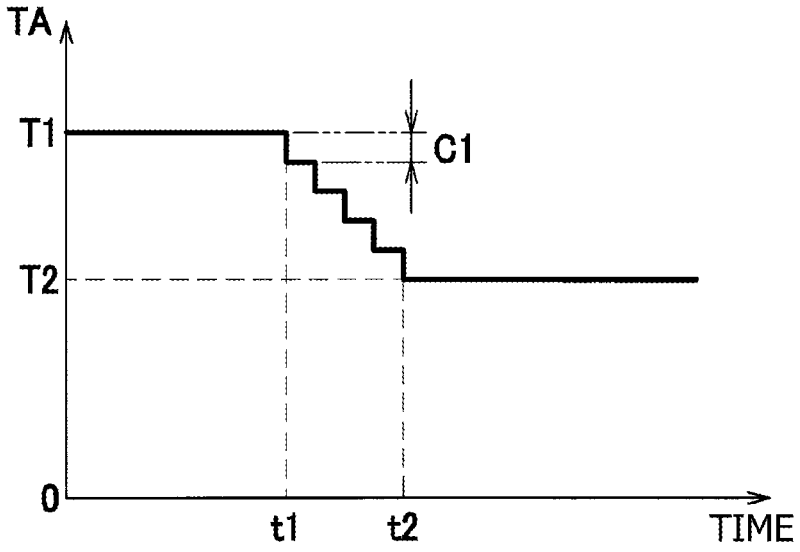
FIG. 9 is a graph to illustrate shifts of thresholds in the second modified example of the flow of steps to be taken by the controller in the laser printer according to the embodiment of the present invention.

With this flow, as shown in FIG. 9, after the width W of the sheet S obtained in the obtaining operation changes from the predetermined width WA or greater to the width smaller than the predetermined width WA (time: t1) and until the predetermined length of period elapses (time: t2), a plurality of thresholds, which decrease gradually by the constant C1 from the first threshold T1 to the second threshold T2, may be set to be the threshold TA. After the predetermined length of period (time: t2 and onward), the second threshold T2 should be greater than the difference calculated by subtracting the constant C1 from the threshold TA; therefore, the threshold TA may stay at the second threshold T2.

Figure 10A:
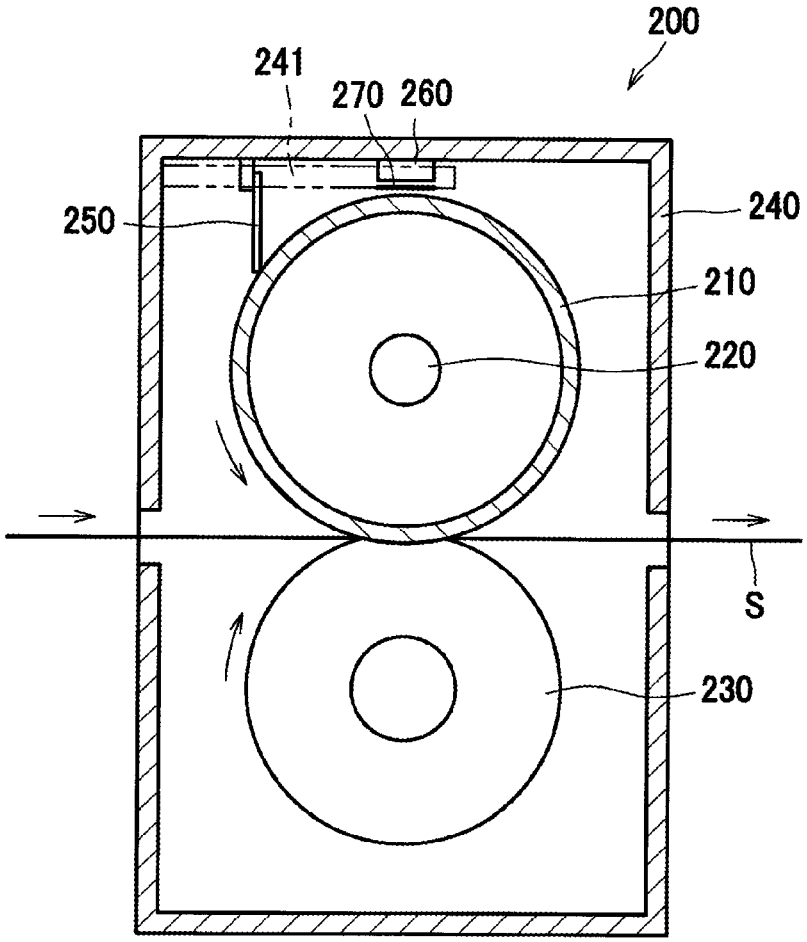
FIG. 10A is a cross-sectional view of the fixing unit in the laser printer according to another modified example of the present invention.

For another example, the fixing unit 100 may not necessarily be equipped with the fixing belt 110 that is heated by the heater 120 to fix the image on the sheet S, but a fixing unit 200 may be equipped with, for example, a heat roller 210 as shown in FIG. 10A.

In the fixing unit 200, the heat roller 210 may be formed in a cylindrical shape, in which a heater 220 to heat the heat roller 210 is disposed, and a pressure roller 230 may be urged against the heat roller 210. As the sheet S passes through an intermediate position between the heat roller 210 and the pressure roller 230, the sheet S may be heated.

In the previous embodiment, the lateral thermistor 400A detects the temperature in the first detectable part 134A of the nipper board 130 to detect the lateral end part of the fixing belt 110 indirectly. Meanwhile, according to the above-mentioned configuration as shown in FIG. 10A, a side thermistor 250 may directly contact the lateral end part of the heat roller 210 to detect the temperature therein.

Figure 10B:
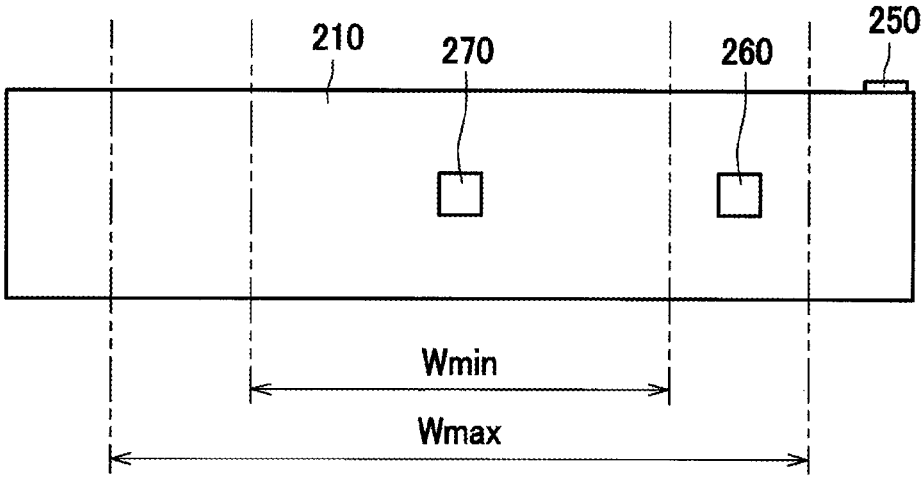
FIG. 10B is a plan view of a heat roller, a side thermistor, a thermostat, and a central thermistor in the laser printer according to the modified example of the present invention.

In particular, the lateral thermistor 250 may be supported by a frame 240, which may accommodate the heat roller 210 and the pressure roller 230, and may contact a surface of the heat roller 210. In this regard, as shown in FIG. 10B, the side thermistor 250 may be disposed laterally outside the maximum width sheet pathway Wmax with regard to the widthwise direction. Meanwhile, a thermostat 260 and a central thermistor 270 may be arranged to face with and spaced apart from the heat roller 210, as shown in FIG. 10A.

As shown in FIGS. 10A-10B, the thermostat 260 may be fixed to the frame 240 in an upper position with respect to the heat roller 210, inside the maximum width sheet pathway Wmax and laterally outside the minimum width sheet pathway Wmi with regard to the widthwise direction. The thermostat 260 may be configured to shut down the electricity to the heater 220 when the temperature in a part of the heat roller 210 facing with the thermostat 260, which may be estimated based on a temperature detected by the thermostat 260, is determined to be higher than or equal to the third threshold.

Meanwhile, the central thermistor 270 may be supported by a supporting member 241, which may be fixed to the frame 240, in a position laterally inside the minimum width sheet pathway Wmin with regard to the widthwise direction, and may be configured to detect a temperature in a part of the heat roller 210 facing with the central thermistor 270.

In the previous embodiment, the temperature in the lateral end part of the fixing belt 110 may be lowered by lowering the temperature in the central part of the fixing belt 110 and lowering the conveying velocity VA to convey the sheet S in the cooling operation, which may be activated by the output from the cooling-commander unit 85. However, a cooling method to lower the temperature in the fixing belt 110 may not necessarily be limited to that described above. For example, the temperature in the lateral end part of the fixing belt 110 may be lowered by stopping the printing operation for a predetermined length of period or by placing a longer interval between the sheets S being fed according to output from the cooling-commander unit 85. Additionally or alternatively, a cooling device such as a fan may be employed.

For another example, in the obtaining operation, the width W of the sheet S may not necessarily be determined based on the output from the sheet sensor 9 but may be determined by output from a sensor (not shown), which detects a position of the paired side-guides 34. For another example, the width W of the sheet S being conveyed may be determined based on changes of the temperatures in the central thermistor 400C and the side thermistor 400A.

For another example, the width W of the sheet S may not necessarily be determined between the two values: the value greater than or equal to the predetermined width WA; or the value smaller than the predetermined width WA. But the width W of the sheet S may be determined among three or more width ranges. In this regard, the threshold TA may be set among three or more values, each of which corresponds to one of the three or more width ranges. Additionally or alternatively, the methods to lower the temperature in the fixing belt 110 may be varied depending on the thresholds TA.

For another example, the paired side-guides 34 may not necessarily be configured to move to be closer to each other toward the widthwise center to restrict the positions of the widthwise ends of the sheets S, but one of the paired side-guides may be movable to be closer to the other of the paired side-guides along the widthwise direction so that one of the widthwise ends of the sheet S on the movable one of the paired side-guides may be restricted. In this regard, the side thermistor may be arranged to detect a temperature in the lateral end part of the fixing belt 110 on the side of the movable one of the paired side-guides with regard to the widthwise direction.

For another example, the sheet S may not necessarily be paper but may be, for example, an OHP sheet.

What is claimed is:

1. An image forming apparatus, comprising:

an image forming unit configured to form an image in a developer agent on a sheet;

a fixing unit comprising a heater, the fixing unit being configured to fix the image in the developer agent on the sheet;

an end temperature sensor disposed on an end area of the fixing unit with regard to a direction of width of the sheet; and a controller configured to perform:

a width obtaining step, in which the controller obtains the width of the sheet;

a temperature obtaining step, in which the controller obtains a temperature of the fixing unit detected by the end temperature sensor;

a comparison step, in which the controller compares the detected temperature with a threshold;

a cooling step, in which the controller manipulates the heater to let the end area of the fixing unit cool down when the temperature detected by the end temperature sensor is one of higher and equal to the threshold; and a threshold-setting step, in which the controller sets a first value to be the threshold when the width of the sheet obtained in the width obtaining step is one of greater and equal to a predetermined width, and in which the controller sets a second value smaller than the first value to be the threshold when the width of the sheet obtained in the width obtaining step is smaller than the predetermined width, the second value corresponding to a lower conveying velocity to convey the sheet than a conveying velocity corresponding to the first value.

2. The image forming apparatus according to claim 1, wherein the end temperature sensor is disposed outside a pathway, in which the sheet with a maximum usable width is allowed to pass through.

3. The image forming apparatus according to claim 1, further comprising:

a side-guide comprising a restrictive face, the restrictive face being configured to restrict a position of the sheet with regard to the widthwise direction, wherein the end temperature sensor is disposed on an outer side of the restrictive face with regard to the widthwise direction.

4. The image forming apparatus according to claim 3, wherein the side-guide is movable along the widthwise direction.

5. The image forming apparatus according to claim 4, wherein the side-guide comprises a first side-guide, a second side-guide arranged to be spaced apart from the first side-guide along the widthwise direction, and a link to couple the first-side guide and the second side-guide to be movable in conjunction with each other.

6. The image forming apparatus according to claim 1, wherein, in the threshold-setting step, the controller is configured to hold for a predetermined length of time from a point, at which the width of the sheet obtained in the width-obtaining step changes from one of greater than and equal to the predetermined width to a width smaller than the predetermined width, before setting the second value to be the threshold.

7. The image forming apparatus according to claim 6, wherein, in the threshold-setting step, the controller sets values decreasing gradually from the first value to the second value to be the threshold within the predetermined length of time.

8. The image forming apparatus according to claim 6, wherein, in the threshold-setting step, the controller is configured to maintain the first value to be the threshold for the predetermined length of time from the point, at which the width of the sheet obtained in the width-obtaining step changes from one of greater than and equal to the predetermined width to the width smaller than the predetermined width, and to set the second value to be the threshold after the predetermined length of time.

9. The image forming apparatus according to claim 1, further comprising:

a central temperature sensor disposed inside a pathway for the sheet with a minimum width, wherein the controller is configured to control a temperature in the heater according to a temperature detected by the central temperature sensor.

10. The image forming apparatus according to claim 9, further comprising:

a thermal cutoff configured to shut down electricity to the heater.

11. The image forming apparatus according to claim 1, wherein the second value corresponds to a temperature lower than a temperature corresponding to the first value.

12. An image forming apparatus comprising:

an image forming unit configured to form an image in a developer agent on a sheet;

a fixing unit comprising a heater, the fixing unit being configured to fix the image in the developer agent on the sheet;

an end temperature sensor disposed on an end area of the fixing unit with regard to a direction of width of the sheet; and a controller configured to perform:

a width obtaining step, in which the controller obtains the width of the sheet;

a temperature obtaining step, in which the controller obtains a temperature of the fixing unit detected by the end temperature sensor;

a comparison step, in which the controller compares the detected temperature with a threshold;

a cooling step, in which the controller manipulates the heater to let the end area of the fixing unit cool down when the temperature detected by the end temperature sensor is one of higher and equal to the threshold; and a threshold-setting step, in which the controller sets a first value to be the threshold when the width of the sheet obtained in the width obtaining step is one of greater and equal to a predetermined width, and in which the controller sets a second value smaller than the first value to be the threshold when the width of the sheet obtained in the width obtaining step is smaller than the predetermined width, wherein, the controller is configured to hold for a predetermined length of time from a point, at which the width of the sheet obtained in the width-obtaining step changes from one of greater than and equal to the predetermined width to a width smaller than the predetermined width, before setting the second value to be the threshold.

13. The image forming apparatus according to claim 12, wherein, in the threshold-setting step, the controller sets values decreasing gradually from the first value to the second value to be the threshold within the predetermined length of time.

14. The image forming apparatus according to claim 12, wherein, in the threshold-setting step, the controller is configured to maintain the first value to be the threshold for the predetermined length of time from the point, at which the width of the sheet obtained in the width-obtaining step changes from one of greater than and equal to the predetermined width to the width smaller than the predetermined width, and to set the second value to be the threshold after the predetermined length of time.

15. A non-transitory computer readable medium storing computer readable instructions that are executable by a computer to control an image forming apparatus, when executed by the computer, the image forming apparatus comprising an image forming unit configured to form an image in a developer agent on a sheet; a fixing unit comprising a heater, the fixing unit being configured to fix the image in the developer agent on the sheet; and an end temperature sensor disposed on an end area of the fixing unit with regard to a direction of width of the sheet, the computer readable instructions being configured to cause the computer to control the image forming apparatus by performing:

a width obtaining step, in which the controller obtains the width of the sheet;

a temperature obtaining step, in which the controller obtains a temperature of the fixing unit detected by the end temperature sensor;

a comparison step, in which the controller compares the detected temperature with a threshold;

a cooling step, in which the controller manipulates the heater to let the end area of the fixing unit cool down when the temperature detected by the end temperature sensor is one of higher and equal to the threshold; and a threshold-setting step, in which the controller sets a first value to be the threshold when the width of the sheet obtained in the width obtaining step is one of greater and equal to a predetermined width, and in which the controller sets a second value smaller than the first value to be the threshold when the width of the sheet obtained in the width obtaining step is smaller than the predetermined width, wherein, the controller is configured to hold for a predetermined length of time from a point, at which the width of the sheet obtained in the width-obtaining step changes from one of greater than and equal to the predetermined width to a width smaller than the predetermined width, before setting the second value to be the threshold.

16. The non-transitory computer readable medium according to claim 15, wherein, in the threshold-setting step, the controller sets values decreasing gradually from the first value to the second value to be the threshold within the predetermined length of time.

17. The non-transitory computer readable medium according to claim 15, wherein, in the threshold-setting step, the controller is configured to maintain the first value to be the threshold for the predetermined length of time from the point, at which the width of the sheet obtained in the width-obtaining step changes from one of greater than and equal to the predetermined width to the width smaller than the predetermined width, and to set the second value to be the threshold after the predetermined length of time.

* * * * *